US007331152B2

(12) United States Patent
Menke

(10) Patent No.: US 7,331,152 B2
(45) Date of Patent: Feb. 19, 2008

(54) BEVERAGE BOTTLING PLANT FOR FILLING BEVERAGE BOTTLES HAVING A BEVERAGE BOTTLE ORIENTATION AND POSITIONING ARRANGEMENT

(75) Inventor: Herbert Menke, Burgbrohl (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 0 days.

(21) Appl. No.: 11/551,616

(22) Filed: Oct. 20, 2006

(65) Prior Publication Data

US 2007/0095017 A1 May 3, 2007

(30) Foreign Application Priority Data

Oct. 21, 2005 (DE) ..... 10 2005 050 902

(51) Int. Cl.
*B65C 9/06* (2006.01)
*B65B 57/10* (2006.01)
*B65B 61/00* (2006.01)

(52) U.S. Cl. ..... 53/67; 53/136.1; 53/167; 53/281; 156/363; 156/379; 156/DIG. 27; 198/376; 198/395; 382/142

(58) Field of Classification Search ..... 53/167, 53/136.1, 281, 300, 308, 67; 156/363, 379, 156/DIG. 27, DIG. 12; 198/395, 376, 377.01; 382/142; *B65C 9/06*
See application file for complete search history.

(56) References Cited

U.S. PATENT DOCUMENTS

| | | | | |
|---|---|---|---|---|
| 3,451,523 | A * | 6/1969 | Evans, Jr. et al. | 198/395 |
| 4,878,333 | A * | 11/1989 | Sommerfield | 53/67 |
| 6,308,816 | B1 * | 10/2001 | Bankuty et al. | 198/395 |
| 6,378,587 | B1 * | 4/2002 | Frist | 156/363 |
| 6,494,238 | B2 * | 12/2002 | Sindermann | 141/129 |
| 7,013,624 | B2 * | 3/2006 | Zwilling | 53/135.1 |

FOREIGN PATENT DOCUMENTS

| | | | |
|---|---|---|---|
| DE | 199 04 732 | | 9/1999 |
| DE | 202 03 529 | | 6/2002 |
| DE | 103 06 671 | | 8/2004 |
| EP | 1 205 388 | | 5/2002 |
| JP | 61-238957 | | 10/1986 |
| JP | 04-367432 | A * | 12/1992 |
| WO | WO 03/024808 | A2 * | 3/2003 |
| WO | WO 2004/056658 | A1 * | 7/2004 |

* cited by examiner

*Primary Examiner*—Stephen F. Gerrity
(74) *Attorney, Agent, or Firm*—Nils H. Ljungman & Associates

(57) ABSTRACT

A beverage bottling plant for filling beverage bottles having a beverage bottle orientation and positioning arrangement. The orientation and positioning arrangement includes the use of cameras, and an evaluation and control system. A first camera is configured and disposed to scan the external or peripheral surface of the beverage bottle over a wide area. A second camera is configured and disposed to scan the external or peripheral surface of the beverage bottle over a narrower area than the first camera.

20 Claims, 5 Drawing Sheets

$d' = d - R*\cos(\gamma)$ $x' = R*\sin(\gamma)$ $d/d' = x/x'$

===>

$$x = \frac{d*R*\sin(\gamma)}{d - R*\cos(\gamma)}$$

BEVERAGE BOTTLING PLANT FOR FILLING BEVERAGE BOTTLES HAVING A BEVERAGE BOTTLE ORIENTATION AND POSITIONING ARRANGEMENT

BACKGROUND

1. Technical Field

This application relates to a beverage bottling plant for filling beverage bottles having a beverage bottle orientation and positioning arrangement. This application further relates to a device for the accurate positioning and orientation of containers, such as beverage bottles, as described herein.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station; as well as a loading station that is configured to load filled bottles into containers, for example, in a six-pack arrangement. There may also be provided a conveyor arrangement configured to transfer filled bottles from the closing station to the loading station.

Many beverage bottling plants are designed to operate at very high speeds in order to process as many bottles as possible in as short a time as possible. Modern high-speed, high-capacity beverage bottling plants can process huge numbers of bottles in a relatively short time, such as approximately 40,000 to 70,000 bottles per hour. What is meant by "process" is completing at least the acts of cleaning the empty bottles, filling the bottles with a liquid beverage, closing the filled bottles, labeling the bottles, and packaging the bottles for transport to sellers or distributors. With containers and in particular with bottles that have typical geometric container characteristics on their outer surface such as, for example, sealing surfaces, ornaments, embossing, raised characters etc., it is necessary to apply the labels with a high degree of accuracy with reference to these container characteristics. That means that on a labeling machine to which the containers are fed in an upright position although in a purely random orientation, these containers must first be oriented so that they are in an orientation that is as accurate as possible with reference to their container characteristics. Only then can the at least one label be applied to the respective container and then pressed or brushed onto it.

For this orientation in similar devices of the prior art, container receptacles, e.g. in the form of turntables, are provided on a rotor of a labeling machine. Each container receptacle can be rotated by means of its own servo motor around a vertical axis and thus also around the axis of the respective container located on the container receptacle. Specifically, the prior art also describes the control of the container receptacles for the orientation of the containers as a function of an image analysis or camera system, with which the respective position or orientation of at least one typical geometric container characteristic that is used for the orientation is measured as an actual value and this data is then compared in an electronic system with image data or parameters stored there that represent the specified value, and based on the result, the servo motor of the container receptacle required for the necessary position correction is actuated (EP 1 205 388). On one model of this device of the prior art, the camera system has four cameras that are located one after another along the path of movement of the container receptacles in the direction of rotation of the rotor. Each camera thereby scans a portion of the periphery of the container, and namely each camera scans 100° of this periphery in an overlapping manner on containers that rotate around their container axis. On the basis of the actual image data supplied by the cameras, a correction of the rotational position of the container receptacles is then made and the container is oriented with reference to its typical geometric container characteristic.

OBJECT OR OBJECTS

One object of the present application is to disclose a beverage bottling plant for filling beverage bottles having a beverage bottle orientation and positioning arrangement. Another object of the present application is to indicate a device with which containers can be oriented with reference to at least one typical geometric container characteristic with significantly improved accuracy, and in particular even at a high throughput, i.e. when a large number of containers are processed per unit of time.

SUMMARY

According to at least one device described in the present application, on the basis of image data from a first camera system, containers are pre-oriented so that after the pre-orientation, they are more or less accurately in the required orientation, in particular with reference to their geometric container characteristics used for the orientation, and specifically with an accuracy that is at least as good as can be achieved with device of the prior art. With this first camera system, the inspection area, i.e. the peripheral area of the individual container in which the at least one geometric container characteristic is located, is scanned over a large area.

With the image data of the at least one additional camera system, a more accurate and possibly even the final orientation of each container is performed. Because the area of the container scanned by the at least one camera of the at least one additional camera system is very much smaller than the area to be scanned by the at least one camera of the first camera system, i.e. the at least one camera of the additional camera system, e.g. a very much smaller aperture angle, than the at least one camera of the first camera system, the orientation can be accomplished using the image data supplied by the at least one additional camera system very precisely and in an extremely short time.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct embodiment, and maintains that this application may include more than one patentably and non-obviously distinct embodiment. The Applicant hereby asserts that the disclosure of this application may include more than one possible embodiment, and, in the event that there is more than one possible embodiment, that these possible embodiments may be patentable and non-obvious one with respect to the other.

BRIEF DESCRIPTION OF THE DRAWINGS

The present application is explained in greater detail below on the basis of the exemplary embodiments illustrated in the accompanying figures, in which.

DESCRIPTION OF EMBODIMENT OR EMBODIMENTS

Figure 1:
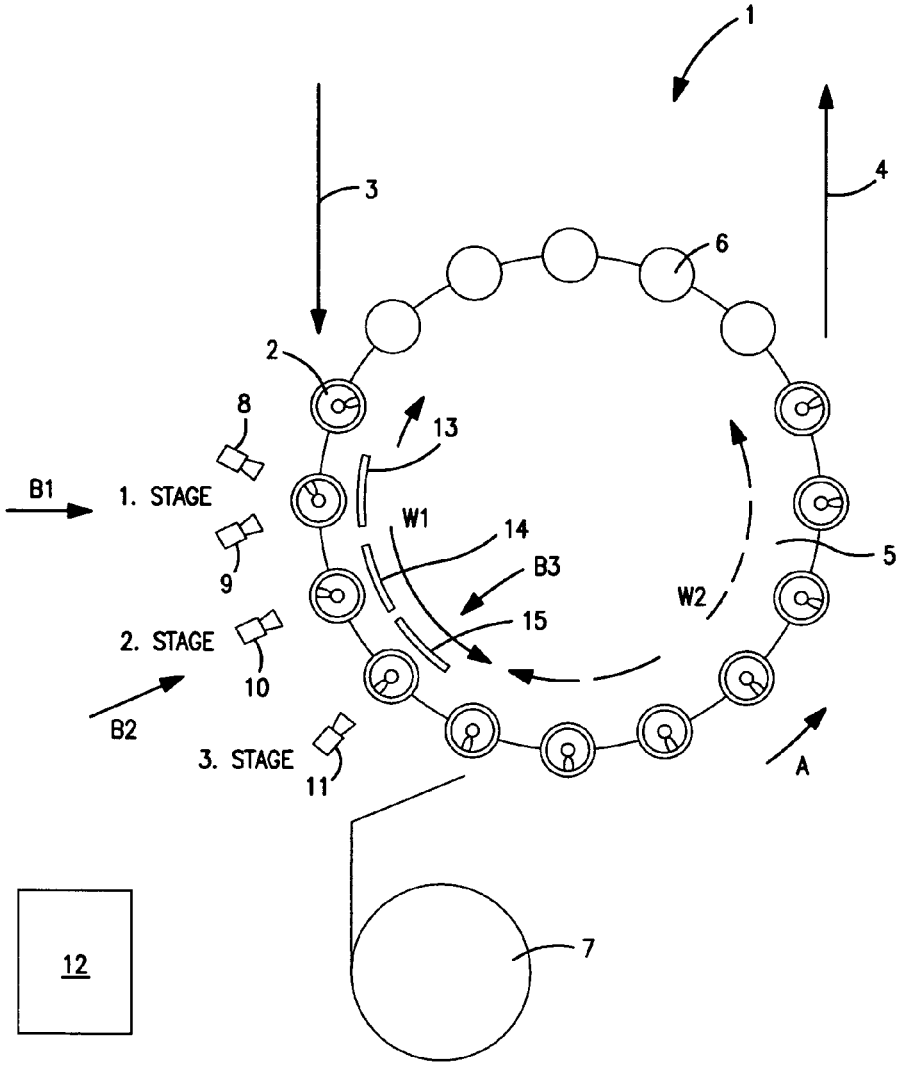
FIG. 1 is a schematic illustration of an information adding or labeling machine with a rotary construction.
Figure 1A:
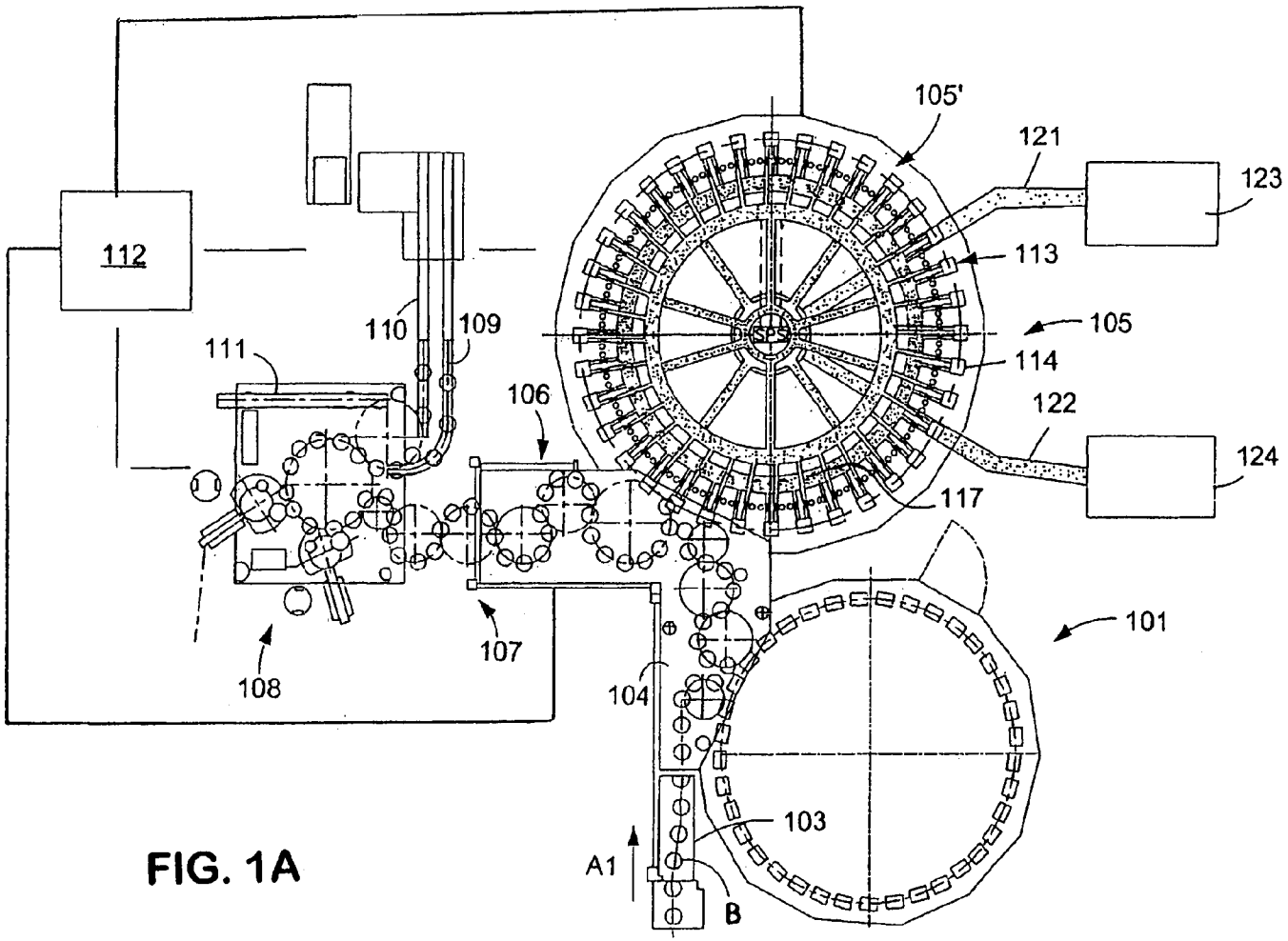
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 6 in the labeling stations 108 corresponding to this first product delivered from product mixer 123 to the beverage filling machine 105 and thence to the corresponding bottles B. One embodiment of a labeling station, or labeling machine, is described in greater detail herein below with reference to FIG. 1.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 6' in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 8 that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises bottle carriers or container carriers 113*a* that are configured and disposed to present bottles B for filling, as well as a filling device or element or apparatus 114 located or configured to be located above the corresponding container carrier 113*a* and the corresponding bottle B presented by the carrier 113*a*. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix 1, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

The information adding or labeling machine illustrated in FIG. 1 and designated 1 in general is used for the labeling of containers 2, such as bottles, for example, which are fed to the labeling machine 1 at a container inlet 3 and are discharged from the labeling machine 1 after labeling at a container outlet 4. The containers 2 are, for example, bottles that are made of a translucent material, e.g. glass, and are provided on the outside of the containers with at least one typical geometric container characteristic, such as a sealing surface, ornamentation, embossing, raised characters etc., for example. The containers 2 must be provided with the labels with a high degree of application accuracy with reference to these geometric characteristics.

The labeling machine 1 comprises, among other things, the turntable or rotor 5 which is driven so that it rotates around a vertical machine axis in the direction indicated by the arrow A, and on its periphery has a plurality of container carriers or receptacles 6 which are distributed at uniform angular intervals around the vertical machine axis and on each of which a container 2 is provided for the application of the labels parallel to the vertical machine axis.

The containers 2 are fed to the labeling machine 1 at the container inlet 3 via a conveyor (not shown) in the upright position, of course, i.e. with their container axis oriented in the vertical direction, but otherwise in a random, purely arbitrary orientation with regard to their typical geometric container characteristics, are each transferred to a container receptacle 6 in this purely arbitrary orientation and are then oriented in an angular range W1 of the rotational movement A of the rotor 5, so that at the end of this angular area each container 3 is correctly oriented with reference to its typical geometric container characteristics, i.e. is in a specified orientation. In this position, each container 2 is moved past a labeling station 7 that does not move with the rotor 5 for the application of at least one label, so that the label is then applied to the respective container 2 with the desired high degree of application accuracy with reference to the geometric container characteristics. In the angular range W2 of the rotational movement A of the rotor 5, downstream of the labeling station 7 and continuing to the container outlet 3, the label is pressed and/or brushed on in the conventional manner. For the orientation of the containers 2, the container receptacles 6 can each be rotated by means of their own servo motors around an axis parallel to the vertical machine axis, and specifically under the control of a multiple-stage image analysis system that is explained in greater detail below with a plurality of electronic cameras 9-11 and a corresponding electronic analysis and control system 12 formed by a computer.

An example of a label inspection system and components thereof that may possibly be utilized or adapted for use in at least one possible embodiment of the present application is the KHS Metec Innocheck ETI, made by KHS Metec GmbH, Industriegebiet Scheid 16, D-56651 Niederzissen, Germany, which is described in the KHS Metec Innocheck brochure entitled, "Everything under Control—with Inspection Technology from KHS Metec" as "a high-performance unit made of stainless steel for inspecting up to ten labels with a precision of ±1.0 mm at speeds of up to 70,000 bottles/h."

An example of a labeling system and components thereof that may possibly be utilized or adapted for use in at least one possible embodiment of the present application is the KHS Innoket KL 2060, made by KHS AG, Juchostrasse 20, D-44143 Dortmund, Germany.

An example of a camera system and components thereof that may possibly be utilized or adapted for use in at least one possible embodiment of the present application is the Pixelfly high performance digital 12 bit CCD camera system, made by PCO AG, Donaupark 11, 93309 Kelheim, Germany.

In the illustrated exemplary embodiment, the cameras 8-11 that are not driven with the rotor 5 are each located radially outside the path of movement of the container receptacles 6 such that with each camera, the containers 2 that are moved past the camera are scanned at least in the inspection area or in the area of their outside container surface that has the typical geometric container characteristics. All of the cameras 8-11 are also located within the angular range W1 and thus upstream of the labeling station 7 in the direction of rotation A.

In detail, the two cameras 8 and 9, which are located in a portion of the angular range W1 that is downstream of the container inlet 3, form a first camera system or a first stage of the image analysis system, and specifically together with a background element that is not driven with the rotor 5 and forms a white background or a white background reflector, which in the illustrated exemplary embodiment is located radially inward with reference to the circular path of movement of the container receptacles 6 and opposite the two cameras 8 and 9, and together with foreground lighting that is indicated with the arrow B1. The two cameras 8 and 9 are arranged with their optical axis at an angle to each other so that they can be used to scan a peripheral area or a developed surface greater than 180° of the container 2 that is moved past them. The images or image data supplied by the two cameras 8 and 9 are combined into a composite image or a composite data set, for example, which corresponds to an image of the developed surface or of the peripheral area of the container greater than 180°.

The first stage of the image analysis system is followed by the second stage of this system which is formed by the single camera 10. The camera 10 is in turn associated with the background element 14 which corresponds to the element 13 and forms a white background or a white background reflector, and specifically in the illustrated exemplary embodiment radially inward with reference to the path of movement of the container receptacle 6. This second stage also has foreground lighting, as indicated by the arrow B2. Of course, the elements 13 and 14 of the first and second stages can also be formed by a single continuous element. The foreground lighting can also be formed for both stages by one or more common light sources, such as fluorescent screens, for example. Basically, depending on the optical characteristics of the container, an illumination technology will be selected for the foreground illumination that makes possible an optimal scanning of the container characteristics that are used for the orientation of the containers. With a special configuration of the background element 13 and/or 14, for example by a partial darkening of the white background element 13 and/or 14, an improved optical scanning of edge profiles of the container characteristics used for the orientation can be achieved.

An example of a camera or imaging control system and components thereof that may possibly be utilized or adapted for use in at least one possible embodiment of the present application is the Innocheck PROMECON 2000, made by KHS Metec GmbH.

Downstream of the second stage (camera 10) in the direction of rotation A is the third stage of the image analysis system formed by the single camera 11, and specifically with background illumination B3, which for example comprises a fluorescent screen 15 that does not move with the rotor 5 on the side of the path of movement of the container receptacle 6 opposite the camera 11. The background lighting B3 can be selected or adjusted in terms of color and/or intensity as a function of the optical characteristics of the containers 2 or of the container material and/or as a function of the optical characteristics of the liquid being bottled for an optimal optical scanning.

In detail, the orientation of the containers 2 with the image analysis system is performed so that with the first stage or with the two cameras 8 and 9 located there, the individual random orientation of the container 2 being moved passed is scanned with one image per container and per camera 8 or 9. By a subsequent comparison of the images or image data supplied by the two camera systems 8 and 9 in the evaluation and control system or electronic system 12 with images or image data or typical parameters stored there in a data memory for the corresponding type of container, the electronic system 12 determines the current orientation of the respective container 2, from that orientation determines the correction required to achieve the required pre-orientation, and performs the correction by a corresponding actuation of the servo motor of the respective container receptacle 6.

For each individual container 2, in the manner described above, by actuation of the container receptacle 6, the position correction is carried out so that each container 2 is oriented at least with a positioning accuracy which makes possible the subsequent accurate detection of the position of the at least one typical container characteristic that is used for the final orientation.

In the second stage of the image analysis system formed by the camera 10, each container 2 that is moved past is scanned in a narrow area of its typical geometric container characteristic. The optical system of the camera 10 is realized, for example, so that the optical aperture angle of the camera 10 is smaller than the corresponding aperture angle of the cameras 8 and 9 and the area of the respective container that has the typical geometric container characteristic is imaged so that it fills as much of the format as possible. The image thus generated of each container 2 is in turn compared in the electronic system 12 with an image that is stored there for the type of container in question or with parameters that are stored for the type of container in question, the required position correction is determined from the analysis and this correction is then initiated by an appropriate actuation of the servo motor of the respective container receptacle 6. As a result of the reduction of the area of the image to the area of the typical container characteristic, the second stage of the image analysis system already achieves a very accurate and greatly improved orientation of each container 2, in particular compared to the pre-orientation (with the first stage).

With the third stage formed by the camera 11, there is then a precision adjustment or precision orientation of each container 2 before the container 2 reaches the labeling station 7. For example, at least one edge profile or at least one typical edge point can be used as the criterion for this precision orientation, and namely the at least one typical container characteristic that is used for the orientation and/or in the vicinity of this container characteristic. The image data supplied by the camera 11 are in turn compared in the electronic system 12 with image data for the respective container type that are stored there or with parameters that are stored there for the respective container type, so that then from this comparison, any additional position correction that may be necessary is calculated and can be achieved by the appropriate actuation of the servo motor of the container receptacle in question.

With the three-stage optical scanning of the containers 2 or of the typical container characteristics described above, a very accurate orientation of the containers that are fed to the labeling machine in an arbitrary orientation or positioning can be achieved with only four cameras, before the containers reach the labeling station 7, so that the desired application accuracy is essentially guaranteed during the application of the labels with reference to the typical geometric container characteristics with a high degree of reliability, even at a very high throughput of the labeling machine, e.g. with a labeling throughput of several tens of thousands of containers per hour. An example of a label inspection system that may possibly be utilized or adapted for use in at least one possible embodiment is the KHS Metec Innocheck ETI, which is described in a KHS Metec Innocheck brochure, entitled "Everything under control—with Inspection Technology from KHS Metec," as "a high-performance unit mad of stainless steel for inspecting up to ten labels with a precision of ±1.0 mm at speeds of up to 70,000 bottles/h."

The details of an algorithm as it is used in at least one of the stages of the image analysis system for the determination of the required correction are explained below.

To be able to precisely determine the angle of rotation to within an accuracy of at least one degree, the cylindrical geometry of the bottle surface must be taken into consideration. With the known imaging geometry (distance from the camera to the bottle, diameter of the bottle) and the known geometry of the embossing pattern, by means of the calculation illustrated below, for each angle of rotation of the bottle (e.g. in 0.5 degree steps), it is possible to calculate how the embossing pattern is distorted for an observer (=camera) on the bottle surface. These calculated distorted embossing patterns must then be compared with the observed embossing pattern on a photographed bottle. The calculated embossing pattern that coincides best with the observed pattern defines the angle of rotation of the bottle.

Figure 2:
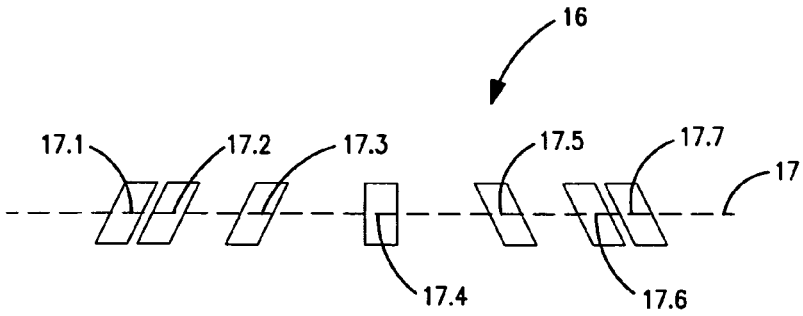
FIGS. 2-7 show various illustrations to explain the algorithm used for the determination of the angle of rotation of the container receptacles required to correct the orientation.

FIG. 2 shows, by way of one example of a typical container characteristic, an embossed pattern 16 on a bottle in an almost frontal view. The edge of the bottle and the middle of the bottle are each illustrated by a thin vertical red line. Let this frontal view correspond to the angle of rotation zero degrees. Naturally, the null point of the angle of rotation is defined on the basis of the symmetry of the embossing pattern (i.e. "in the middle of the embossing pattern"). Along the horizontal test line 17, those points 17.1-17.7 are indicated at which the embossing intersects the test line 17. These points are called the embossed points below. The variable $x_i$ is the observed position of an embossed point in a recorded image, and $z_i$ indicates the world coordinates on the surface of the bottle. The sequential index i is used to number the individual embossed points.

Figure 3:
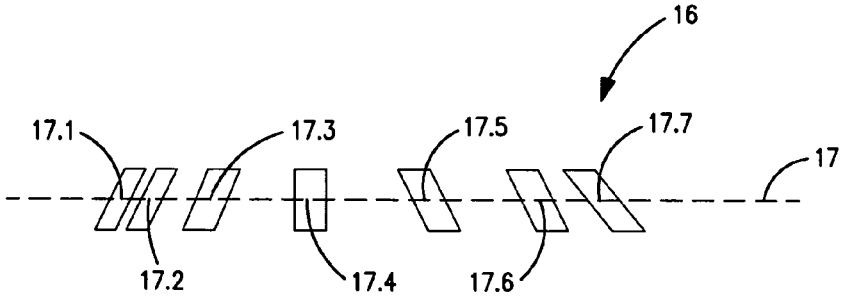
Figure 4:
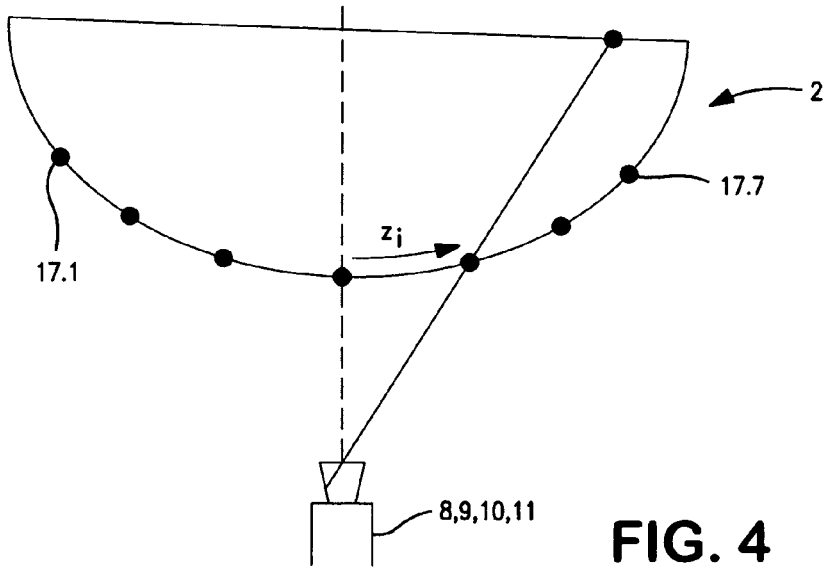

FIG. 3 shows the same embossing pattern, whereby the bottle 24 has been rotated by 24 degrees to the left. The embossed points are also marked in this figure. As a result of the rotation of the bottle, the position and the distances between the embossed points 17.1-17.7 have changed in a characteristic manner. For example, on account the perspective distortion on the cylindrical bottle, the observed distance between two neighboring embossed points that have come nearer to the left edge of the bottle has changed from the non-rotated position. When the bottle is rotated even farther, parts of the embossed pattern will disappear behind the bottle horizon.

Figure 5:
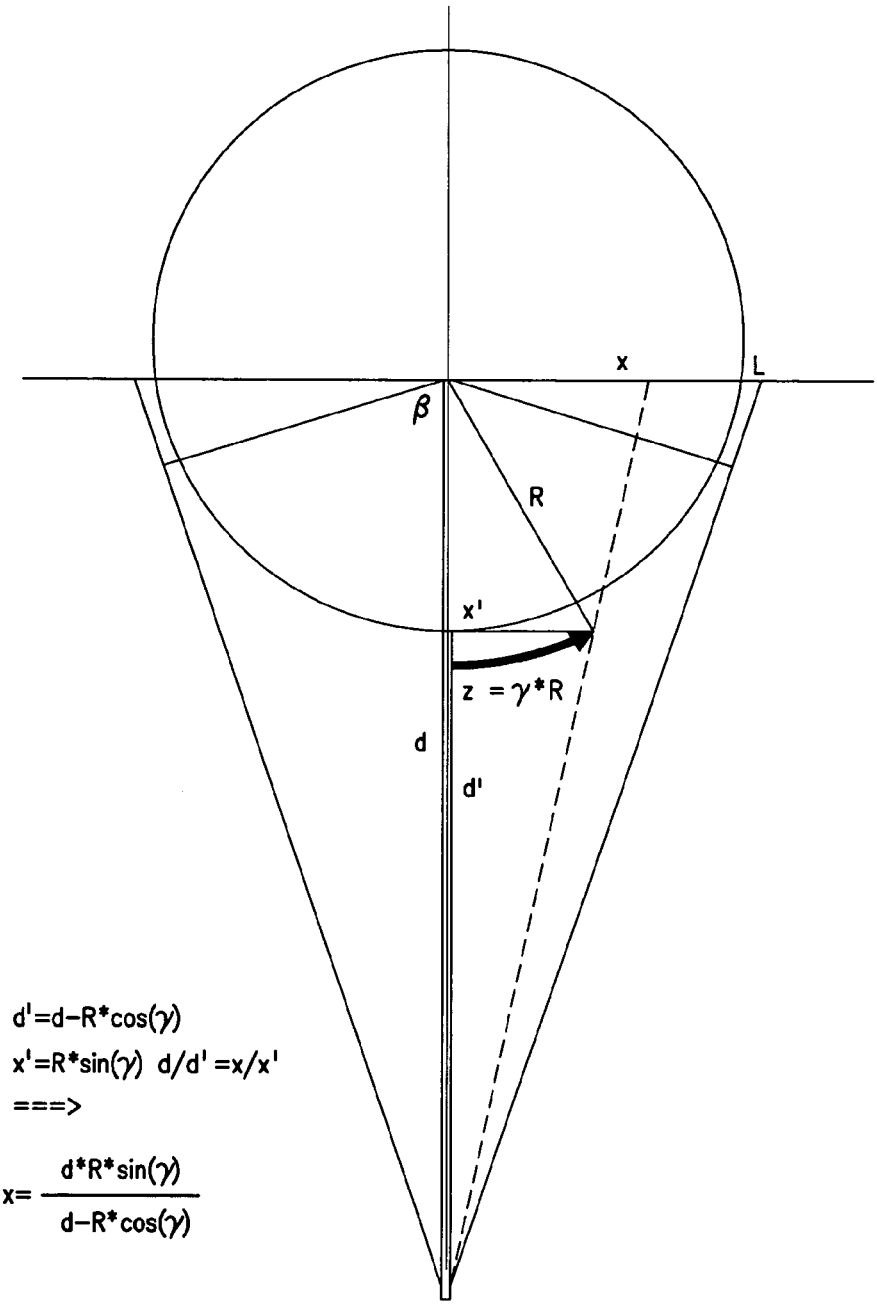

A geometric calculation that corresponds to FIG. 5 leads to the formulas (1) and (2).

Formula (1):

$$x_i = \frac{dR\sin(z_i/R)}{d - R\cos(z_i/R)}$$

Formula (2):

$$z_i = 2R\arctan\left(\frac{dR - \sqrt{d^2R^2 + x_i^2(R^2 - d^2)}}{x(d+R)}\right)$$

where R indicates the bottle radius and d the distance from the camera to the center of the bottle.

With these formulas, it is possible to convert the observed position $x_i$ of embossed points 17.1-17.7 into world coordinates $z_i$ on the bottle surface and vice-versa. To be able to calculate the exact distribution of the embossed points 17.1-17.7 along a horizontal test line 17 at any arbitrary angle of rotation of the bottle, the position $z_i$ of all embossed points 17.1-17.7 on the bottle surface with a known angle of rotation (e.g. at zero degrees) with reference to the axis of symmetry (null point) of the embossing pattern must be known. The position $z_i$ of an embossed point is thereby defined by the distance from the observed bottle center measured along the bottle surface. Theoretically, the position $z_i$ of the individual embossed points can now be measured with reference to the center line by applying a measuring tape to the bottle and making the measurements available in a list to the detection algorithm. However, Formula (2) makes it possible to obtain this information directly from a recorded image. For this purpose, in the image with a known angle of rotation, the observed position $x_i$ is determined. With a known bottle radius R and a known distance d to the respective camera (8, 9, 10, 11), the world coordinates $z_i$ can thereby be determined by means of Formula (2). The learning of an embossing pattern for the analysis algorithm is thereby greatly simplified. As indicated by the embossed points 17.1-17.7 in FIGS. 2 and 3, a user guide can be incorporated in a computer program in which a user can mark the points of intersection of the embossed pattern with a test line 17. By means of Formula (2), the screen function $x_i$ selected by clicking on it can then be immediately converted into world coordinates $z_i$ on the bottle surface. Thus the user can make the embossing pattern available to the algorithm in the form of a list of embossed points 17.1-17.2.

Once the embossed points $z_i$ are determined in world coordinates for an embossing pattern, the embossed points can be converted for any arbitrary angle of rotation of the bottle via the Formula (1) in reverse into observed positions $x_i$. The analysis algorithm can therefore calculate for all possible angles of rotation $\phi$ of the bottle the observed positions $x_i(\phi)$ for the given embossing pattern. In practice, it has been found that the analysis algorithm performs this calculation for all angles of rotation $\phi k$ at an angular interval of 0.25 degrees, i.e. $\phi$=0.25 degrees*k with k=0, ±1, ±2, ±3 . . . For each angle $\phi k$, the algorithm can keep the corresponding distribution of the observed positions $x_i(\phi k)$ in the memory, and therefore does not need to recalculate for the pattern search for the next bottle with the same embossing pattern. This procedure saves a great deal of computer time.

Next, the algorithm must then decide what distribution $x_i(\phi k)$ best fits the situation observed in the image. For this purpose, a method is used that associates a score Sk with each distribution $x_i(\phi k)$. This score is interpreted so that it is higher, the better the observed situation fits a distribution. The highest score $Sk_{Max}$, which is achieved for a given image situation, thereby defines the angle of rotation $\phi k_{Max}$ of the bottle.

Figure 6:
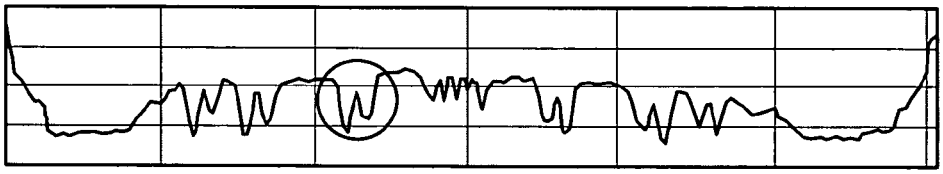

For the calculation of a score Sk, first the brightness curve H(x) along the test line 17 is determined (FIG. 6). x thereby indicates the pixel position along the horizontal test profile. In a brightness profile of this type, embossed points are visible by significant brightness fluctuations on a length scale which corresponds to the approximate width of an embossed point. However, other brightness fluctuations are superimposed on these brightness fluctuations, all of which take place on a significantly longer length scale and can thus be separated in the following manner from the brightness fluctuations caused by embossed points: From the brightness profile H(x), a brightness profile $H_{Ave}(x)$ is calculated which is smoothed over a length scale which is significantly greater than the width of an embossed point. This smoothed brightness profile $H_{Ave}(x)$ is subtracted from the original brightness profile H(x) and considers only the amounts of the differences, i.e. $H_{Sub}(x)=|H(x)-H_{Ave}(s)|$ Areas in which there are no embossed points then have very small values $H_{Sub}(x)$, while on the other hand, high values are found at an embossed point. In this manner, by the selection of a suitable threshold, the positions $b_i$ of the embossed points in the given image can be identified.

The score Sk for a distribution of the observed positions $x_i(\phi k)$ is then calculated using the following procedure:

The pair of points $b_i$ and $x_i$ with the shortest distance between them is sought. If this distance is less than a specified maximum distance d, the point pair found is evaluated as matching, i.e. it is assumed that the position of the embossed point $b_i$ found in the image matches a position of the embossing pattern for the bottle rotation $\phi k$. In this case, a bonus is added to the score Sk. Because the embossing pattern of different bottles will never be exactly identical, and because the bottle geometry and the bottle position in relation to the camera during the recording of the image are subject to fluctuations, it can never be assumed that there will be an exact coincidence of a point pair $b_i$ and $x_i$. Therefore the maximum distance d requires that the points must lie sufficiently close together. If a point pair is found in this manner, these points are marked as already associated in an internal list of the algorithm. For the remaining points, the process is then repeated until all possible points have either been associated or until all the points have been recognized as not associable (i.e. for a point $b_i$, no model point $x_i$ can be found that lies sufficiently close). If no corresponding points $b_i$ were found for model points $x_i$, penalties are then subtracted from the score Sk.

Figure 7:
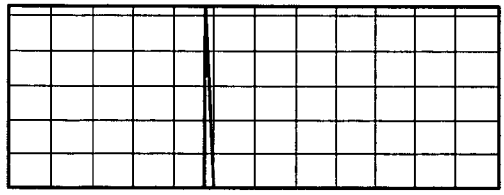

FIG. 7 shows, for the example illustrated in FIG. 3, the score Sk as a function of the angle. It is obvious that there is a sharp maximum at approximately −24 degrees, i.e. the observed point pattern $b_i$ corresponds best with the point pattern $x_i$ at an angle of rotation of the bottle of −24 degrees.

The present application was described above on the basis of one exemplary embodiment. It goes without saying that numerous modifications and variations are possible without thereby going beyond the teaching of the present application. For example, it was assumed above that the first stage of the image analysis system has two cameras 8 and 9 and the second or third stage each have only one camera 10 and 11 respectively. It goes without saying that the number of cameras in these stages can also be different, whereby it is necessary, however, or at least appropriate, for the camera system of the first stage to scan the largest possible peripheral area of the container 2 being moved past it.

In the illustrated exemplary embodiment, the cameras 8, 9, 10 and 11 are each realized or actuated so that they are provided with an image or an image data set of each container 2 that is moved past them, and then on the basis of this image data set perform the pre-orientation (in the first stage), the pre-adjustment (in the second stage) and the precision adjustment (in the third stage) by a comparison with the respective image data.

One feature or aspect of an embodiment is believed at the time of the filing of this patent application to possibly reside broadly in a device for the orientation of containers (2) with reference to at least one geometric container characteristic (16) in a specified position or orientation, with a conveyor (5) with container receptacles (6) to hold one container each, and with cameras (8, 9, 10) of an image recognition system located along a conveyor line formed by the conveyor (5), which image recognition system effects an orientation of the containers (3) by a comparison of the actual image data supplied by the cameras (8, 9, 10, 11) with specified image data or parameters stored in an electronic evaluation and control system (12), characterized in that with a first camera system that forms a first stage of the image recognition system, the container (3) is pre-oriented and the at least one camera (8, 9) of this first camera system scans the external or peripheral surface of the container over a wide area which has the typical container characteristics, that at least one additional camera system that is downstream in the direction of transport, for the additional orientation, with its at least one camera (10, 11) scans the container (2) that is being transported past it for a further orientation in a narrower area of the peripheral surface that has at least one typical geometric container characteristic (16), and that if there are deviations from the specified position, the electronic system, on the basis of additional stored image data or parameters, effects an additional orientation via the actuator drive of the respective container receptacle (6).

Another feature or aspect of an embodiment is believed at the time of the filing of this patent application to possibly reside broadly in the device wherein in the transport direction (A) of the conveyor (5), downstream of the first camera system that forms the first stage of the image recognition system there is a second camera system that forms a second stage of the image recognition system, and a third camera system that forms a third stage of the image recognition system, each with at least one camera (10, 11).

Yet another feature or aspect of an embodiment is believed at the time of the filing of this patent application to possibly reside broadly in the device wherein with the first camera system or the at least one camera (8, 9) of this system, a circumferential area of the respective container (2) greater than 180° is scanned.

Still another feature or aspect of an embodiment is believed at the time of the filing of this patent application to possibly reside broadly in the device wherein the first camera system has at least two cameras (8, 9), which are arranged relative to one another with their camera axes at an angle.

A further feature or aspect of an embodiment is believed at the time of the filing of this patent application to possibly reside broadly in the device wherein the images or image data supplied by the at least two cameras (8, 9) of the first camera system are combined in the electronics (12) into a comprehensive image.

Another feature or aspect of an embodiment is believed at the time of the filing of this patent application to possibly reside broadly in the device wherein at least one camera system has at least two cameras (8, 9).

Yet another feature or aspect of an embodiment is believed at the time of the filing of this patent application to possibly reside broadly in the device wherein the at least one additional camera system, in particular the second and third camera system, each have only one camera (10, 11).

Still another feature or aspect of an embodiment is believed at the time of the filing of this patent application to possibly reside broadly in the device wherein the camera systems or their cameras are realized for the generation of single images of the containers (3) transported past them.

A further feature or aspect of an embodiment is believed at the time of the filing of this patent application to possibly reside broadly in the device wherein the cameras (8, 9, 10, 11) of the camera systems are constructed and/or controlled so that they generate only one image of each container (2) that is transported past them.

Another feature or aspect of an embodiment is believed at the time of the filing of this patent application to possibly reside broadly in the device wherein at least one camera system, preferably the first camera system, is realized with foreground illumination (B1, B2).

Yet another feature or aspect of an embodiment is believed at the time of the filing of this patent application to possibly reside broadly in the device wherein at least one camera system, for example the at least one additional camera system or the third camera system, is realized for the generation of images or image data by translucence.

Another feature or aspect of an embodiment is believed at the time of the filing of this patent application to possibly reside broadly in the device wherein at least one camera system is realized with background illumination.

Yet another feature or aspect of an embodiment is believed at the time of the filing of this patent application to possibly reside broadly in the device wherein the foreground or background lighting can be adjusted in terms of color and/or intensity.

Still another feature or aspect of an embodiment is believed at the time of the filing of this patent application to possibly reside broadly in the device wherein the conveyor is a rotor (5) that can be driven in rotation around a vertical machine axis.

A further feature or aspect of an embodiment is believed at the time of the filing of this patent application to possibly reside broadly in the device wherein each container receptacle has its own actuator drive.

Another feature or aspect of an embodiment is believed at the time of the filing of this patent application to possibly reside broadly in the device wherein the container receptacles (6) are turntables.

Yet another feature or aspect of an embodiment is believed at the time of the filing of this patent application to possibly reside broadly in the device wherein the electronic system (12) compares the spacing the at least two reference points (17.1-17.7) of the typical container characteristic (16) off the individual container (2) in the image data supplied by the at least one camera (8, 9, 10, 11) with parameters that are stored for the container type.

Still another feature or aspect of an embodiment is believed at the time of the filing of this patent application to possibly reside broadly in the device wherein the electronic system compares a plurality of spacings from a spacing pattern between reference points (17.12-17.7) of the typical container characteristic (16) of the respective container (2)

in the image data supplied by the at least one camera (8, 9, 10, 11) with at least one spacing pattern that is stored for the container type.

A further feature or aspect of an embodiment is believed at the time of the filing of this patent application to possibly reside broadly in the device wherein the electronic system (12) compares the spacing or the spacing pattern of the reference points (17.1-17.7) in the image data supplied by the at least one camera (8, 9, 10, 11) with spacings or spacing patterns that are stored for the container type, determines the spacing pattern that coincides best with the spacing in the image data, the spacing pattern, and from the comparison determines the necessary correction for the orientation of the container (2).

Another feature or aspect of an embodiment is believed at the time of the filing of this patent application to possibly reside broadly in the device wherein the device is a component of a labeling machine (1) with a container inlet (3) for the containers (2) to be labeled, with a container outlet (4) for the labeled containers (2) and with at least one labeling station (7) provided on a conveyor line formed by the conveyor (5) between the container inlet (3) and the container outlet (4), and that the first camera system and the at least one additional camera system are provided on the conveyor line between the container inlet (3) and the at least one labeling station (7).

Yet another feature or aspect of an embodiment is believed at the time of the filing of this patent application to possibly reside broadly in the device wherein the conveyor is a rotor (5) that revolves around a vertical machine axis with a plurality of container receptacles (6).

Another feature or aspect of an embodiment is believed at the time of the filing of this patent application to possibly reside broadly in each container receptacle can be rotated by a servo-drive that is actuated by the electronic system for the orientation of the container (3) provided on this receptacle.

Yet another feature or aspect of an embodiment is believed at the time of the filing of this patent application to possibly reside broadly in a labeling machine with a device for the orientation of containers (2) with reference to at least one geometric container characteristic (16) in a specified position or orientation.

Device for the orientation of containers with reference to at least one geometric container characteristic, with a conveyor with container receptacles, each of which holds one container, and with cameras of an image analysis system located along a conveyor line formed by the conveyor, which image analysis system, by means of a comparison of the actual image data supplied by the cameras with specified image data or parameters stored in an analysis and control electronic system effects the orientation of the containers.

An example of a image processing system or program is the NeuroCheck system produced by NeuroCheck GmbH, D-71686 Remseck, Germany.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The components disclosed in the various publications, disclosed or incorporated by reference herein, may possibly be used in possible embodiments of the present application, as well as equivalents thereof.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The components disclosed in the various publications, disclosed or incorporated by reference herein, may possibly be used in possible embodiments of the present application, as well as equivalents thereof.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

The appended drawings in their entirety, including all dimensions, proportions and/or shapes in at least one embodiment of the present application, are accurate and are hereby included by reference into this specification.

Some examples of memories that may possibly be utilized or possibly adapted for use in at least one possible embodiment of the present application may possibly be found in the following U.S. Patents: U.S. Pat. No. 5,789,887 issued to Elischewski on Aug. 4, 1998; U.S. Pat. No. 5,453,736 issued to Noren on Sep. 26, 1995; U.S. Pat. No. 5,315,220 issued to Takimoto et al. on May 24, 1994; U.S. Pat. No. 4,994,724 issued to Hsu on Feb. 19, 1991; U.S. Pat. No. 4,498,033 issued to Aihara et al. on Feb. 5, 1985; and U.S. Pat. No. 4,328,540 issued to Matsuoka et al. on May 4, 1982.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of microprocessors that may possibly be utilized or possibly adapted for use in a possible embodiment of the present application may possibly be found in the following U.S. patents: U.S. Pat. No. 5,770,934 issued to Theile on Jun. 23, 1998; U.S. Pat. No. 5,653,056 issued to Stark on Aug. 5, 1997; U.S. Pat. No. 5,647,173, issued to Stark et al. on Jul. 15, 1997; U.S. Pat. No. 5,625,266 issued to Stark on Apr. 29, 1997; U.S. Pat. No. 5,479,151 issued to Lavelle et al. on Dec. 26, 1995; and U.S. Pat. No. 5,453,736 issued to Noren on Sep. 26, 1995.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of databuses or databus systems that may possibly be utilized or possibly adapted for use in at least one possible embodiment of the present application may possibly be found in the following U.S. patents: U.S. Pat. No. 6,008,546 issued to Sage on Dec. 28, 1999; U.S. Pat. No. 5,978,193 issued to Kaaden on Nov. 2, 1999; U.S. Pat. No. 5,815,732 issued to Cooper et al. on Sep. 29, 1998; U.S. Pat. No. 5,507,001 issued to Nishizawa on Apr. 9, 1996; U.S. Pat. No. 5,402,423 issued to Van Kersen on Mar. 28, 1995; and U.S. Pat. No. 4,725,838 issued to Maschek et al. on Feb. 16, 1998.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Some examples of cameras or the like optical monitoring apparatus that may possibly be utilized or possibly adapted for use in at least one possible embodiment of the present application may possibly be found in the following U.S. patents: U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

The sentence immediately above relates to patents, published patent applications and other documents either incorporated by reference or not incorporated by reference.

All of the patents, patent applications or patent publications, which were cited in the German Office Action, corresponding to the German Patent Application No. 10 2005 050 902.9, and/or cited elsewhere are hereby incorporated by reference as if set forth in their entirety herein as follows: German Patent No. 202 03 529, German Patent No. 103 06 671, German Patent No. 199 04 732, and Japanese Patent No. 06-1238957.

The corresponding foreign and international patent publication applications, namely, Federal Republic of Germany Patent Application No. 10 2005 050 902.9, filed on Oct. 21, 2005, having inventor Herbert Menke, and DE-OS 10 2005 050 902.9 and DE-PS 10 2005 050 902.9, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of rotation sensors that may possibly be utilized or possibly adapted for use in at least one possible embodiment of the present application may possibly be found in the following U.S. patents: U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of infrared sensor and infrared receiving arrangements that may possibly be utilized or possibly adapted for use in at least one possible embodiment of the present application may possibly be found in the following U.S. patents: U.S. Pat. No. 4,533,226 issued to Odone on Aug. 6, 1985; U.S. Pat. No. 5,815,108 issued to Terk on Sep. 29, 1998; U.S. Pat. No. 6,010,399 issued to Lee et al. on Jan. 4, 2000; U.S. Pat. No. 6,262,661 issued to Mahler et al. on Jul. 17, 2001; and U.S. Pat. No. 6,377,174 issued to Siegwart et al. on Apr. 23, 2002.

The details in the patents, patent applications and publications may be considered to be incorporable, at applicant's option, into the claims during prosecution as further limitations in the claims to patentably distinguish any amended claims from any applied prior art.

Some examples of light sensors that may possibly be utilized or possibly adapted for use in at least one possible embodiment of the present application may possibly be found in the following U.S. patents: U.S. Pat. No. 4,899,041 issued to Fetter et al. on Feb. 6, 1990; U.S. Pat. No. 5,225,689 issued to Buckle et al. on Jul. 6, 1993; U.S. Pat. No. 5,365,059 issued to Savage on Nov. 15, 1994; U.S. Pat. No. 5,736,733 issued to Shima et al. on Apr. 7, 1998; U.S. Pat. No. 6,493,567 issued to Krivitski et al. on Dec. 10, 2002; and U.S. Pat. No. 6,566,672 issued to Schlough et al. on May 20, 2003.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

The embodiments of the present application described herein above in the context of the preferred embodiments are not to be taken as limiting the embodiments of the present application to all of the provided details thereof, since modifications and variations thereof may be made without departing from the spirit and scope of the embodiments of the present application.

Some examples of laser printing arrangements that may possibly be utilized or possibly adapted for use in at least one possible embodiment of the present application may possibly be found in the following U.S. patents: U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

Some examples of laser marking that may possibly be utilized or possibly adapted for use in at least one possible embodiment of the present application may possibly be found in the following U.S. patents: U.S. Pat. No. 6,429,889 issued to Murokh on Aug. 6, 2002; U.S. Pat. No. 6,483,073 issued to Tenderly on Nov. 19, 2002; U.S. Pat. No. 6,489,985 issued to Brodsky et al. on Dec. 3, 2002; U.S. Pat. No. 6,613,161 issued to Zheng et al. on Sep. 2, 2003; U.S. Pat. No. 6,627,299 issued to Feng et al. on Sep. 30, 2003; and U.S. Pat. No. 6,683,637 issued to Corbett on Jan. 27, 2004.

Some examples of ink jet printing apparatus and methods that may possibly be utilized or possibly adapted for use in at least one possible embodiment of the present application may possibly be found in the following U.S. patents: U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov. 25, 2003; U.S. Pat. No. 6,669,767 issued to Blease et al. on Dec. 30, 2003; and U.S. Pat. No. 6,688,739 issued to Murray on Feb. 10, 2004.

Some examples of screen printing apparatus that may possibly be utilized or possibly adapted for use in at least one possible embodiment of the present application may possibly be found in the following U.S. patents: U.S. Pat. No. 5,374,449 issued to Bühlmann et al. on Dec. 20, 1994;

U.S. Pat. No. 5,722,321 issued to Szyszko et al. on Mar. 3, 1998; U.S. Pat. No. 6,591,745 issued to Miyahara et al. on Jul. 15, 2003; U.S. Pat. No. 6,601,502 issued to Kamen et al. on Aug. 5, 2003; U.S. Pat. No. 6,619,197 issued to Murakami et al. on Sep. 16, 2003; and U.S. Pat. No. 6,659,005 issued to Takahashi et al. on Dec. 9, 2003.

Some examples of tampon printing apparatus that may possibly be utilized or possibly adapted for use in at least one possible embodiment of the present application may possibly be found in the following U.S. patents: U.S. Pat. No. 4,723,485 issued to Berberich et al. on Feb. 9, 1988; U.S. Pat. No. 5,003,872 issued to Dalferth on Apr. 2, 1991; U.S. Pat. No. 5,383,398 issued to Binned on Jan. 24, 1995; U.S. Pat. No. 5,222,433 issued to Philipp on Jun. 29, 1993; U.S. Pat. No. 5,802,972 issued to Hoffmann et al. on Sep. 8, 1998; and U.S. Pat. No. 6,619,203 issued to Philipp on Sep. 16, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiment of the application.

The sentence immediately above relates to patents, published patent applications and other documents either incorporated by reference or not incorporated by reference.

The embodiments of the present application described herein above in the context of the preferred embodiments are not to be taken as limiting the embodiments of the present application to all of the provided details thereof, since modifications and variations thereof may be made without departing from the spirit and scope of the embodiments of the present application.

LEAST PARTIAL NOMENCLATURE

1 Labeling machine
2 Container or bottle
3 Container inlet
4 Container outlet
5 Rotor or turntable
6 Container receptacle
7 Labeling station
8, 9, 10, 11 Electronic camera
12 Evaluation and control electronic system
13, 14 Background element or background reflector
15 Background illumination element, e.g. fluorescent screen
16 Embossing pattern or container characteristic
17 Test line
17.1-17.7 Intersection or embossed point
A Direction of rotation of the rotor 5
B1, B2, B3 Illumination
W1, W2 Angular range of the rotational movement of the rotor

What is claimed is:

1. A high-speed, high-capacity beverage bottling plant for filling beverage bottles with liquid beverage material, said beverage bottling plant comprising:

a plurality of rotary machines comprising at least a rotary beverage bottle filling machine, a rotary beverage bottle closing machine, and a rotary beverage bottle information adding machine;

a first conveyor arrangement being configured and disposed to convey beverage bottles to be filled to said beverage bottle filling machine;

said beverage bottle filling machine being configured and disposed to fill beverage bottles with liquid beverage material;

said beverage bottle filling machine comprising:

a rotor;

a rotatable vertical machine column;

said rotor being connected to said vertical machine column to permit rotation of said rotor about said vertical machine column;

a plurality of beverage bottle filling elements for filling beverage bottles with liquid beverage material being disposed on the periphery of said rotor;

each of said plurality of beverage bottle filling elements comprising a container carrier being configured and disposed to receive and hold beverage bottles to be filled;

each of said plurality of beverage bottle filling elements being configured and disposed to dispense liquid beverage material into beverage bottles to be filled;

at least one liquid reservoir being configured to hold a supply of liquid beverage material and being operatively connected to said plurality of beverage bottle filling elements;

a first star wheel structure being configured and disposed to move beverage bottles into said beverage bottle filling machine;

a second star wheel structure being configured and disposed to move beverage bottles out of said beverage bottle filling machine;

a second conveyor arrangement being configured and disposed to convey filled beverage bottles from said beverage bottle filling machine to said beverage bottle closing machine;

said beverage bottle closing machine being configured and disposed to close tops of filled beverage bottles;

said beverage bottle closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled beverage bottles;

each of said plurality of closing devices comprising a container carrier being configured and disposed to receive and hold filled beverage bottles;

a first star wheel structure being configured and disposed to move filled beverage bottles into said beverage bottle closing machine;

a second star wheel structure being configured and disposed to move filled, closed beverage bottles out of said beverage bottle closing machine;

a third conveyor arrangement being configured and disposed to convey filled, closed beverage bottles from said beverage bottle closing machine to said beverage bottle information adding machine;

said beverage bottle information adding machine being configured and disposed to add information to filled, closed beverage bottles;

said beverage bottle information adding machine comprising:

a rotor;

a rotatable vertical machine column;

said rotor being connected to said vertical machine column to permit rotation of said rotor about said vertical machine column;

a plurality of beverage bottle support structures being disposed on the periphery of said rotor;

said beverage bottle support structures being configured to support and hold filled, closed beverage bottles;

each of said beverage bottle support structures comprising a drive device being configured to rotate its corresponding beverage bottle support structure and a beverage bottle disposed thereon;

a first star wheel structure being configured and disposed to move filled, closed beverage bottles into said beverage bottle information adding machine;

a second star wheel structure being configured and disposed to move labeled beverage bottles out of said beverage bottle information adding machine;

at least one beverage bottle information adding device being configured and disposed to add information to the surface of a beverage bottle;

a beverage bottle orientation and positioning arrangement being configured and disposed to monitor, detect, and analyze the orientation and positioning of beverage bottles on said beverage bottle support structures;

said beverage bottle orientation and positioning arrangement comprising:

an evaluation and control system being operatively connected to said drive devices of said beverage bottle support structures to control rotation of said beverage bottle support structures in order to orient and position said beverage bottles on said support structures in accordance with desired orientation and position data stored in said evaluation and control system;

a first camera system being configured and disposed to acquire images of individual beverage bottles on said beverage bottle support structures as the beverage bottles are initially moved through said beverage bottle information adding machine;

said first camera system comprising at least one camera being configured and disposed to scan the external or peripheral surface of a beverage bottle over a wide area covering typical beverage bottle characteristics;

said evaluation and control system being configured to acquire image data of beverage bottles from said first camera system, compare the acquired image data with the desired orientation and position data, and, upon detection of a deviation of the beverage bottles from the desired orientation and position, effect a rotational movement of said bottle support structures to initially orient and position the beverage bottles in the desired orientation and position;

a second camera system being configured and disposed to acquire images of individual beverage bottles on said beverage bottle support structures as the beverage bottles are moved through said beverage bottle information adding machine downstream of said first camera system;

said second camera system comprising at least one camera being configured and disposed to scan beverage bottles in a narrower area of the peripheral surface that has at least one typical geometric beverage bottle characteristic than said at least one camera of said first camera system; and said evaluation and control system being configured to acquire image data of beverage bottles from said second camera system, compare the acquired image data with the desired orientation and position data, and, upon detection of a deviation of the beverage bottles from the desired orientation and position, effect a further rotational movement of said bottle support structures to orient and position the beverage bottles in the desired orientation.

2. The beverage bottling plant according to claim 1, wherein:

said beverage bottle orientation and positioning arrangement comprises a third camera system disposed downstream of said second camera system;

said third camera system comprises at least one camera being configured and disposed to scan beverage bottles in a narrower area of the peripheral surface that has at least one typical geometric beverage bottle characteristic than said at least one camera of said first camera system; and said evaluation and control system being configured to acquire image data of beverage bottles from said third camera system, compare the acquired image data with the desired orientation and position data, and, upon detection of a deviation of the beverage bottles from the desired orientation and position, effect a further rotational movement of said bottle support structures to orient and position the beverage bottles in the desired orientation and position.

3. The beverage bottling plant according to claim 2, wherein said first camera system is configured and disposed to scan a circumferential area of a beverage bottle greater than 180°.

4. The beverage bottling plant according to claim 3, wherein said first camera system comprises at least two cameras which are arranged relative to one another with their camera axes at an angle.

5. The beverage bottling plant according to claim 4, wherein the image data supplied by said at least two cameras of said first camera system are combined in said evaluation and control system into a comprehensive image.

6. The beverage bottling plant according to claim 5, wherein at least one of: said second camera system and said third camera system comprises only one camera.

7. The beverage bottling plant according to claim 6, wherein said cameras of said camera systems are constructed and/or controlled so that they generate only one image of each beverage bottle that is transported past them.

8. The beverage bottling plant according to claim 7, wherein at least said first camera system comprises foreground illumination.

9. The beverage bottling plant according to claim 8, wherein at least one of: said second camera system and said third camera systems is configured to generate images or image data by translucence.

10. The beverage bottling plant according to claim 9, wherein at least one of said camera systems comprises background illumination.

11. The beverage bottling plant according to claim 10, wherein the foreground or background lighting can be adjusted in terms of color and/or intensity.

12. The beverage bottling plant according to claim 11, wherein:

said drive devices of said beverage bottle support structures comprise servo motors; and said beverage bottle support structures comprise turntables.

13. The beverage bottling plant according to claim 12, wherein said evaluation and control system is configured to compare the spacing of at least two reference points of the typical container characteristic off individual beverage bottles in the image data supplied by said camera systems with parameters that are stored for the beverage bottle type.

14. The beverage bottling plant according to claim 13, wherein said evaluation and control system is configured to compare a plurality of spacings from a spacing pattern between reference points of the typical container characteristic of the individual beverage bottles in the image data supplied by said camera systems with at least one spacing pattern that is stored for the container type.

15. The beverage bottling plant according to claim 14, wherein said evaluation and control system is configured to compare the spacing or the spacing pattern of the reference points in the image data supplied by said camera systems with spacings or spacing patterns that are stored for the beverage bottle type, determine the spacing pattern that coincides best with the spacing in the image data, or the spacing pattern that coincides best with the spacing pattern in the image data, and, from the comparison, determine the necessary correction for the orientation of the beverage bottles.

16. The beverage bottling plant according to claim 15, wherein:

said beverage bottle information adding machine comprises a labeling machine;

said at least one beverage information adding device comprises at least one labeling device; and said camera systems, in the path of movement of the beverage bottles, are disposed between said first star wheel structure and said at least one labeling device.

17. The beverage bottling plant according to claim 1, wherein said beverage bottling plant is configured to process at least 25,000 bottles an hour.

18. The beverage bottling plant according to claim 17, wherein said beverage bottling plant is configured to process at least 40,000 bottles an hour.

19. The beverage bottling plant according to claim 18, wherein said beverage bottling plant is configured to process at least 70,000 bottles an hour.

20. The beverage bottling plant according to claim 19, wherein:

said beverage bottle orientation and positioning arrangement comprises a third camera system disposed downstream of said second camera system;

said third camera system comprises at least one camera being configured and disposed to scan beverage bottles in a narrower area of the peripheral surface that has at least one typical geometric beverage bottle characteristic than said at least one camera of said first camera system;

said evaluation and control system being configured to acquire image data of beverage bottles from said third camera system, compare the acquired image data with the desired orientation and position data, and, upon detection of a deviation of the beverage bottles from the desired orientation and position, effect a further rotational movement of said bottle support structures to orient and position the beverage bottles in the desired orientation and position;

said first camera system is configured and disposed to scan a circumferential area of a beverage bottle greater than 180°;

said first camera system comprises at least two cameras which are arranged relative to one another with their camera axes at an angle;

the image data supplied by said at least two cameras of said first camera system are combined in said evaluation and control system into a comprehensive image;

at least one of: said second camera system and said third camera system comprises only one camera;

said cameras of said camera systems are constructed and/or controlled so that they generate only one image of each beverage bottle that is transported past them;

at least said first camera system comprises foreground illumination;

at least one of: said second camera system and said third camera systems is configured to generate images or image data by translucence;

at least one of said camera systems comprises background illumination;

the foreground or background lighting can be adjusted in terms of color and/or intensity;

said drive devices of said beverage bottle support structures comprise servo motors;

said beverage bottle support structures comprise turntables;

said evaluation and control system is configured to compare the spacing of at least two reference points of the typical container characteristic off individual beverage bottles in the image data supplied by said camera systems with parameters that are stored for the beverage bottle type;

said evaluation and control system is configured to compare a plurality of spacings from a spacing pattern between reference points of the typical container characteristic of the individual beverage bottles in the image data supplied by said camera systems with at least one spacing pattern that is stored for the container type;

said evaluation and control system is configured to compare the spacing or the spacing pattern of the reference points in the image data supplied by said camera systems with spacings or spacing patterns that are stored for the beverage bottle type, determine the spacing pattern that coincides best with the spacing in the image data, or the spacing pattern that coincides best with the spacing pattern in the image data, and, from the comparison, determine the necessary correction for the orientation of the beverage bottles;

said beverage bottle information adding machine comprises a labeling machine;

said at least one beverage information adding device comprises at least one labeling device; and said camera systems, in the path of movement of the beverage bottles, are disposed between said first star wheel structure and said at least one labeling device.

* * * * *